United States Patent [19]

Scranton

[11] 4,439,923

[45] Apr. 3, 1984

[54] SNIP RIDE

[75] Inventor: Joseph A. Scranton, Fremont, Ohio

[73] Assignee: The Clauss Cutlery Company, a Division of Alco Standard Corporation, Fremont, Ohio

[21] Appl. No.: 375,081

[22] Filed: May 5, 1982

[51] Int. Cl.[3] ..... B26B 13/26

[52] U.S. Cl. ..... 30/252; 30/266

[58] Field of Search ..... 30/252, 266, 267, 251

[56] References Cited

U.S. PATENT DOCUMENTS

| | | | |
|---|---|---|---|
| D. 169,114 | 3/1953 | Thober | D54/13 |
| 208,467 | 10/1878 | Conover . | |
| 222,672 | 12/1879 | Conover . | |
| D. 251,955 | 5/1979 | Germain | D8/5 |
| 444,983 | 1/1891 | Krusius . | |
| 740,489 | 10/1903 | Thrasher . | |
| 777,056 | 12/1904 | Eastman . | |
| 796,543 | 8/1905 | Viser . | |
| 805,219 | 11/1905 | Mihills . | |
| 837,590 | 12/1906 | Smith . | |
| 865,918 | 9/1907 | Ladd . | |
| 898,401 | 9/1908 | Booth . | |
| 911,680 | 2/1909 | Regan . | |
| 913,575 | 2/1909 | Sprague . | |
| 1,005,606 | 10/1911 | Craig . | |
| 1,005,661 | 10/1911 | Shirt . | |
| 1,093,726 | 4/1914 | Pearson . | |
| 1,181,637 | 5/1916 | Boye . | |
| 1,273,839 | 7/1918 | Farrer et al. . | |
| 1,321,745 | 11/1919 | Howard . | |
| 1,578,438 | 3/1926 | Hintz | 30/271 |
| 1,584,459 | 5/1926 | Link . | |
| 1,609,638 | 12/1926 | Zeidler . | |
| 1,637,572 | 8/1927 | Isbell et al. . | |
| 1,885,754 | 11/1932 | Nachtigall . | |
| 1,894,787 | 1/1933 | Rauh . | |
| 1,956,588 | 5/1934 | Parker et al. | 30/13 |
| 2,028,867 | 1/1936 | Holden | 30/13 |
| 2,239,851 | 4/1941 | Lincoln | 30/268 |
| 2,292,271 | 8/1942 | Heise | 30/252 |
| 2,372,242 | 3/1945 | Wilson | 30/267 |
| 2,436,260 | 2/1948 | Klenk | 30/252 |
| 2,655,722 | 10/1953 | Klenk | 30/252 |
| 2,746,145 | 5/1956 | Klein, Jr. et al. | 30/186 |
| 2,856,687 | 10/1958 | Beckmann et al. | 30/266 |
| 3,052,026 | 9/1962 | Muller | 30/268 |
| 3,283,404 | 11/1966 | Hickman | 30/271 |
| 3,325,896 | 6/1967 | D'Angelo et al. | 30/248 |
| 3,376,641 | 4/1968 | Usborne | 30/266 |
| 3,474,543 | 10/1969 | Murphy | 30/228 |
| 3,688,402 | 9/1972 | Shannon | 30/260 |
| 4,133,107 | 1/1979 | Vogel | 30/266 |

*Primary Examiner*—Jimmy C. Peters

*Attorney, Agent, or Firm*—Hugh A. Kirk

[57] ABSTRACT

A pair of snips comprising handle levers pivoted at one end and elongated S-shaped centrally pivoted blade cross-pivoted levers pivoted at their ends opposite their blades to said handle levers adjacent their end pivot, which blade levers have integrally formed therewith projections extending radially outwardly from their center cross pivot diametrically opposite the edges of said blades, which projections have contacting surfaces in substantially the same plane as the contacting edges of said blade forming rides for restricting the spreading of said blades axially of their cross pivot.

14 Claims, 5 Drawing Figures

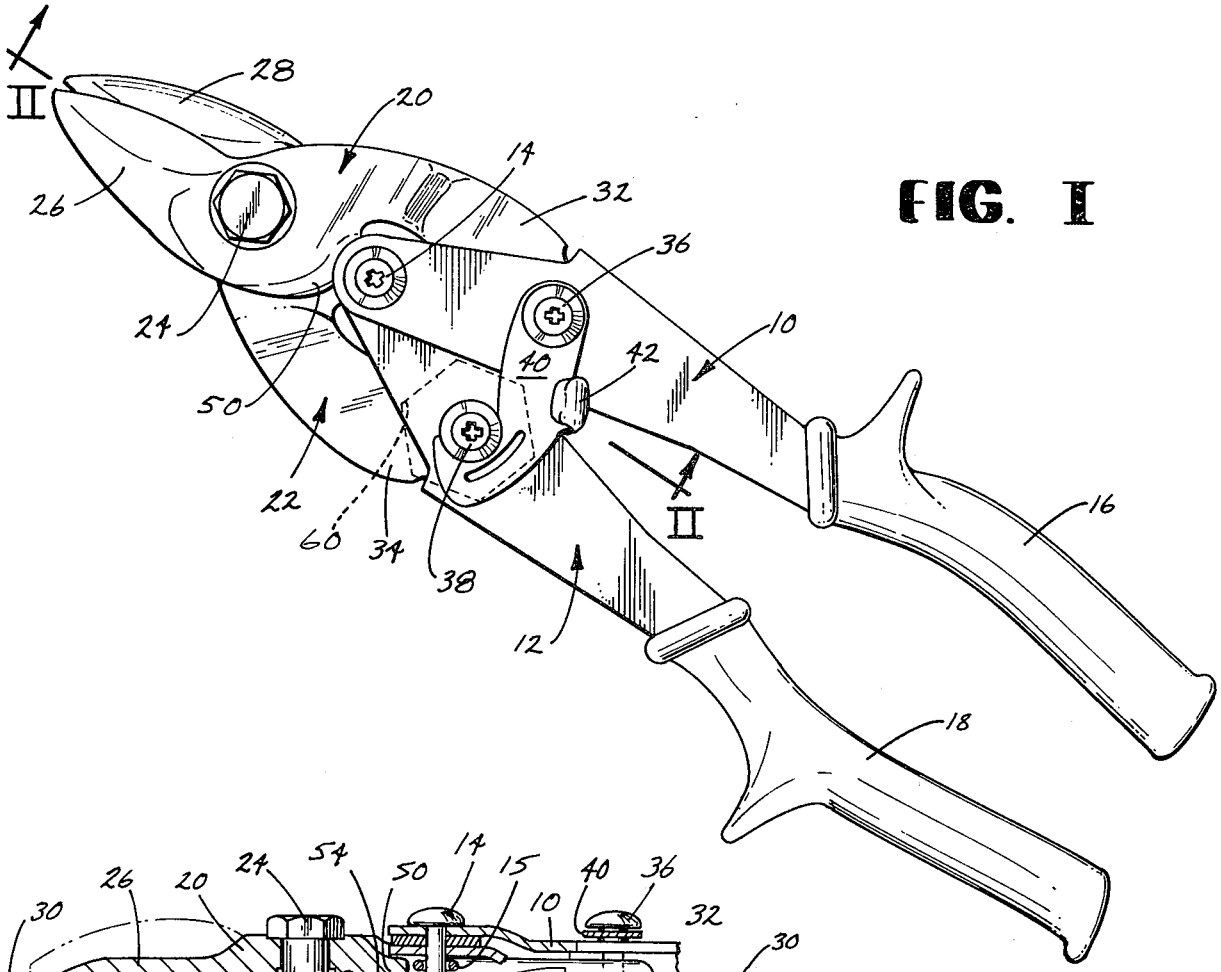
FIG. I
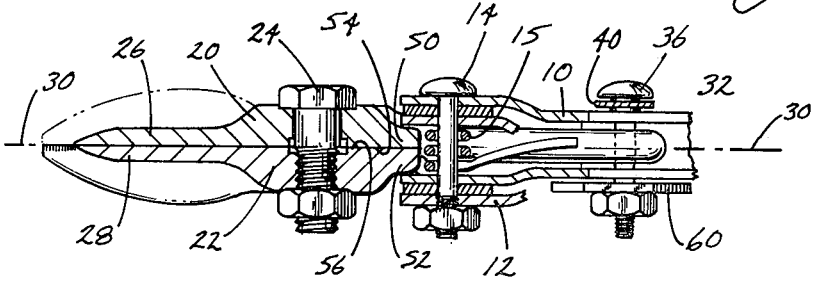
FIG. II
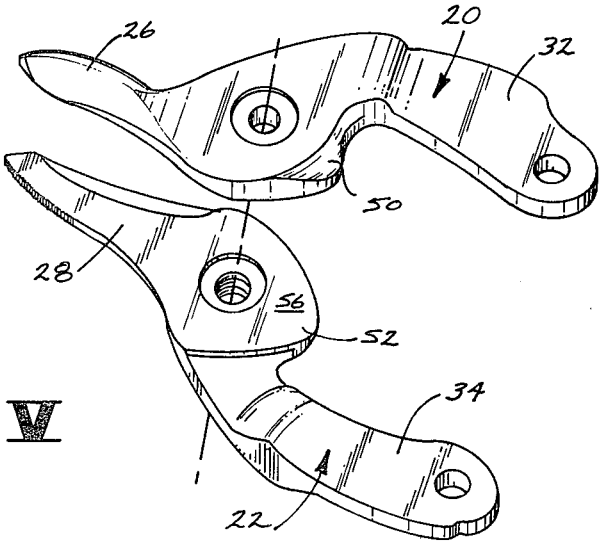
FIG. V

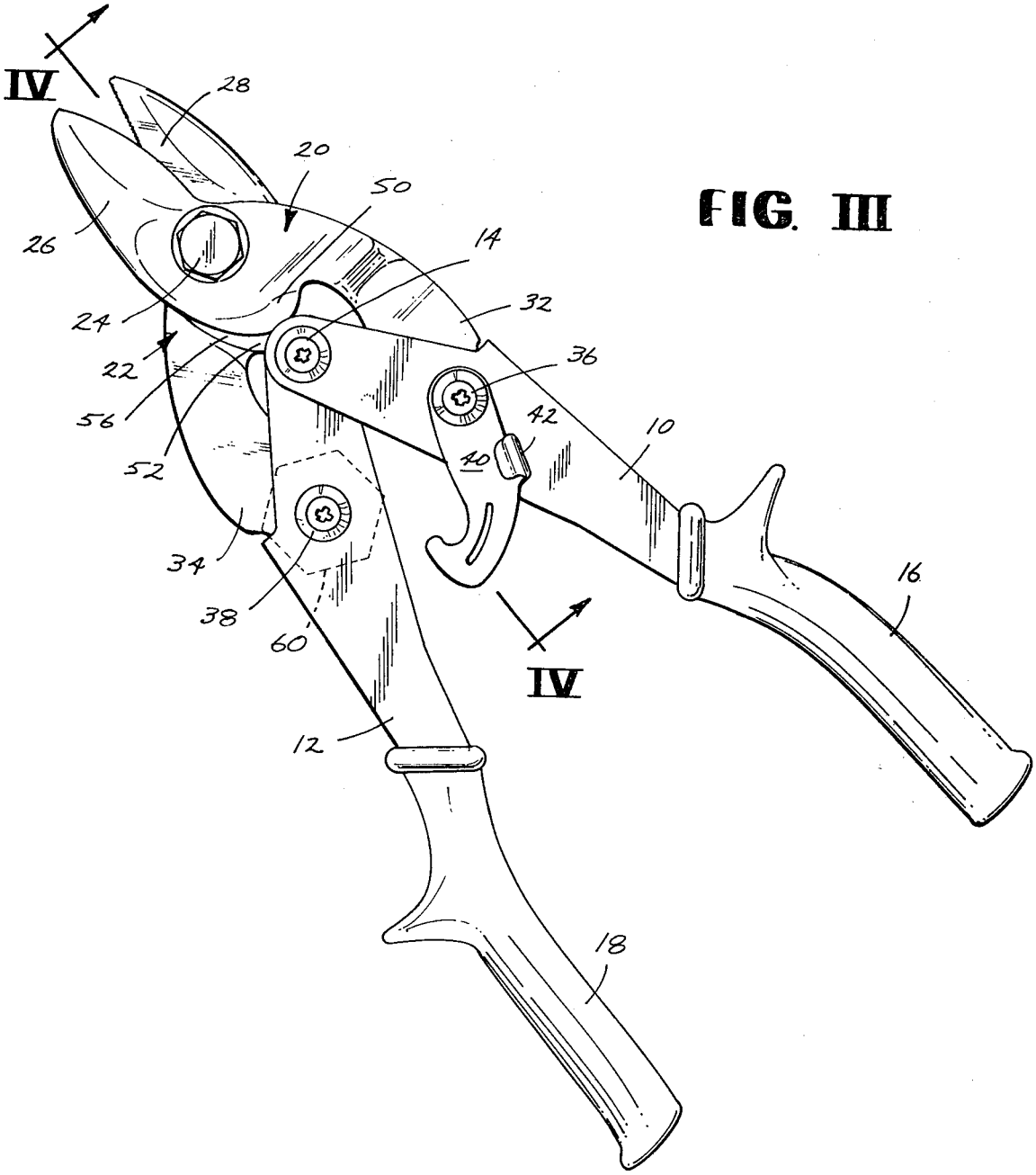
FIG. III
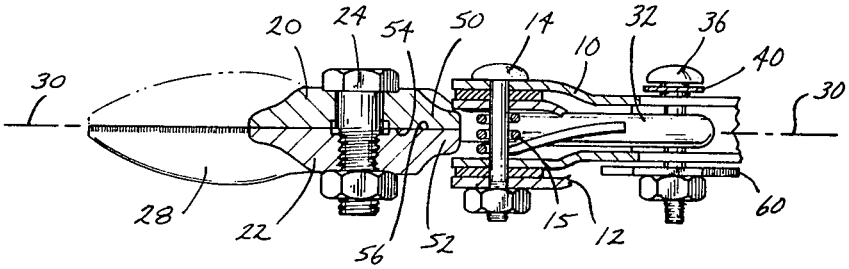
FIG. IV

SNIP RIDE

BACKGROUND OF THE INVENTION

Although it is well known to provide rides on the crossed levers of various types for shears, which rides extend from the central cross pivot toward the handles to restrict spreading of the blades of the shears, such rides, so far as applicant knows, have never been provided on snips with separately pivoted handle levers to crossed blade levers.

It was believed that the relatively close configuration of the crossed blade levers on snips did not require rides nor was there sufficient space between the cross pivot and the handle pivot to include such rides. However, applicant has formed newly shaped crossed blade levers for snips whereby rides could be included, and unexpectedly found that the same size snips could cut through several times more layers of sheet material or thicknesses than before, and without distortion and spreading of the cutting blades axially of their cross pivot.

SUMMARY OF THE INVENTION

Generally speaking, the ride of this invention is incorporated into snips comprising a pair of handle levers pivoted at one end and a pair of crossed centrally pivoted blade levers pivoted at their ends opposite the blades to said handle levers near the pivot for said handle levers.

The invention comprises the addition of an integral ride to the centrally pivoted crossed blade levers which comprises forming the elongated S-shaped blade levers with integral projections aligned diametrically opposite the cutting edges of the blade levers from the central pivot of said blade levers, which projections contain rides or contacting plane surfaces in substantially the same plane as the cutting edges of the two blades. These projections or extensions on the blade levers opposite the blades restrict the spreading of the blades in a direction axial of their central pivot, thereby improving their cutting or snipping function to cut accurately thicker objects than previously could be accurately cut. In order to provide these integral projections with their contacting ride surfaces, the crossed blade levers have to be formed with their curved arms opposite the blades sufficiently longer than the distance between the ends of their pivots to the handle levers and the handle pivot so that there would be no contact between the projections and the handle pivot during the operation of the snips.

The handle levers of the snips may be provided with hand-conforming plastic covers at their handle ends, if desired, and the handle levers also may be provided with a hook for locking their handles together against the action of a helical spring around the handle pivot normally spreading the handles and the blade levers. Furthermore, there may be provided an adjustable eccentrically pivoted polygonal stop along one of the levers to limit the preselected closed positions for the blades.

Accordingly, it is an object of this invention to produce an efficient, effective, economic, strong, reliable snips for accurately cutting through thick and/or multilayers of material.

Another object and advantage of this invention is to improve the cutting function of snips by providing means on their centrally crossed blade levers for restricting the spreading of their cutting edges when cutting through relatively thick objects.

DETAILED DESCRIPTION OF THE VIEWS

The above mentioned and other features, objects and advantages, and a manner of attaining them are described more specifically below by reference to an embodiment of this invention shown in the accompanying drawings, wherein:

FIG. I is a plan view of a preferred embodiment of the present invention with the snip levers locked in their closed position;

FIG. II is a section taken along line II—II of FIG. I showing the projections for the rides of this invention;

FIG. III is a plan view similar to FIG. I with the snip levers in their open position;

FIG. IV is a section similar to FIG. II taken along line IV—IV of FIG. III; and

FIG. V is a perspective view of the two blade cross levers separated ready for assembly showing their integral projection rides according to this invention.

DETAILED DESCRIPTION OF THE PREFERRED EMBODIMENT

Referring first to FIGS. I and III, there is shown a pair of snips comprising handle levers 10 and 12 of U-shaped cross-section (see FIGS. II and IV) pivoted together at one end by pivot means 14, such as a bolt and nut. The free ends of the handle levers 10 and 12 may be provided with plastic hand-conforming insulating covers 16 and 18. These snips also comprise a pair of crossed blade levers 20 and 22 which have elongated S-shaped configurations and which are pivotably connected together near their centers by a pivot means 24, such as a bolt and nut. The outer blade ends 26 and 28 of the blade levers 20, 22, respectively, have their corresponding edges lying in a common plane 30 (see FIGS. II and IV).

The ends 32 and 34 of the blade levers 20 and 22 opposite the blades 26 and 28, respectively, are slightly offset toward each other as shown in FIGS. II and IV so that their center planes lie in the common plane 30, and thus can be conveniently fitted in the U-shaped cross sections of the inner ends of the handle levers 10 and 12 for being pivoted thereto adjacent the pivot 14. These pivots 36 and 38 for the inner ends of the crossed blade levers 20 and 22, respectively, also may comprise bolts and nuts, which at their head ends may have larger diameter shoulder sections for pivoting one end of a locking lever 40 and providing seat for the other hook end of said lever 40. This lever 40 may be provided with an upturned flange portion 42 for engagement of one's fingers for manually moving the lever 40 to and from its locking and unlocking positions as shown in FIGS. I and III, respectively.

As most clearly shown in FIGS. II and IV, the flat blade surfaces adjacent their cutting edges are in the common plane 30 and these surfaces extend completely around the pivot means 24 and further extend diametrically opposite and aligned with the cutting edges of the blades more than the usual distance from the axis of the center pivot 24. These further surface extensions are provided by means of integral projectings 50 and 52 forming rides 54 and 56, respectively, which slide over each other in the plane 30. Thus as shown in FIGS. II and IV, any tendency to spread the blades or blade ends of the levers 20 and 22 away from each other in a direction parallel to the axis of the pivot 24 is materially restricted or prevented by the contacting rides or surfaces 54 and 56 on the projections 50 and 52, which extend diametrically opposite the pivot 24 from the contacting cutting edges and surfaces of the blades 26 and 28. Without these extensions 50 and 52, the increasing wear of the pivot means 24 in the aligned apertures of the two crossed blade levers 20 and 22, permits spreading of the blades edges 26 and 28 and ineffective cutting, particularly when relatively thick materials or a plurality of sheets of material are snipped.

Furthermore, as shown in FIGS. II and IV, the curvatures and the lengths of the offset portions 32 and 34 of the crossed levers 20, 22, permit adequate clearance between the outer ends of the projections 50 and 52 and the pivot 14 as shown in both the closed and open positions of the snips. This clearance is also sufficient so as to avoid contact with the helical spring 15 coiled around the pivot 14 which normally urges the two handle levers 10 and 12 into their open position shown in FIG. III, and against the action of which spring the hook lever 40 must be employed to maintain the snips in their closed position as shown in FIG. I.

Also there may be provided adjustable stop means 60 comprising an eccentrically pivoted pentagon or hexagon-shaped cam on one of the pivots 38 of the blade levers connection to its handle lever 12 for preselecting the limit of the closed position of the handle levers 10 and 12, and correspondingly of the blades 26 and 28.

While there is described above the principles of this invention in connection with specific apparatus, it is to be clearly understood that this description is made only by way of example and not as a limitation to the scope of this invention.

I claim:

1. In a snip comprising a pair of handle levers pivoted together at one end of each lever, a pair of cutting blade levers centrally cross-pivoted together and pivoted at their ends away from their blades to said handle levers near the pivot of said handle levers, the improvement comprising:

projections on said blade levers integral with said levers and extending radially outwardly and aligned diametrically opposite the blades from their cross-pivot, said projections providing rides which extend outwardly substantially more than the radial width of said blade levers orthogonally of said blade edges at their cross-pivot and which rides are in substantially the same plane as the contacting edges of said blades to be in contact with each other when said blades are cooperating for cutting to restrict spreading of said blades in a direction parallel to the axis of their cross-pivot.

2. A snip according to claim 1 wherein said handle levers are provided with plastic covers.

3. A snip according to claim 1 wherein said handle levers include means for releasably holding said levers together.

4. A snip according to claim 3 wherein said holding means comprises a pivoted hook.

5. A snip according to claim 4 wherein said hook is pivoted to one of said pivot means for said crossed blade levers to one of said handle levers and engages said pivot means of the other crossed-blade lever to the other said handle lever.

6. A snip according to claim 1 including stop means for limiting the closing position of said handle levers.

7. A snip according to claim 6 wherein said stop means comprises an eccentrically pivoted polygonal cam, pivoted to one of the handle levers, one of whose polygonal edges is selected to abut an edge of the other handle lever.

8. A snip comprising:

(A) a pair of handle levers, (B) means to pivot said handle levers together at one end of each handle lever, (C) a pair of complementary elongated S-shaped blade levers, (D) means to pivot said blade levers together near their centers, (E) means to pivot the ends of each blade lever opposite from its blade to said handle lever adjacent said means for pivoting said handle levers together, and (F) a radially outwardly extending projection integral with each said blade lever diametrically opposite its central pivot means and aligned with the edge of said blade for providing a ride having a flat surface in substantially the same plane as the edge of said blade, said ride extending radially outwardly substantially more than the radial width of said blade levers orthogonally of said blade edges at their central pivot means, whereby during the cutting action of said blades adjacent surfaces of said rides are in wiping contact with each other to restrict spreading of said blades in a direction parallel to the axis of said pivot means.

9. A snip according to claim 8 wherein said handle levers are provided with plastic hand-conforming covers.

10. A snip according to claim 8 wherein said handle levers include means for releasably holding said levers together.

11. A snip according to claim 10 wherein said holding means comprises a pivoted hook.

12. A snip according to claim 11 wherein said hook is pivoted to one of said pivot means for said crossed blade levers to one of said handle levers and engages said pivot means of the other crossed blade lever to the other said handle lever.

13. A snip according to claim 8 including stop means for limiting the closing position of said handle levers.

14. A snip according to claim 13 wherein said stop means comprises an eccentrically pivoted polygonal cam pivoted to one of the handle levers, one of whose polygonal edges is selected to abut an edge of the other handle lever.

* * * * *